US011566423B2

(12) United States Patent
Chow et al.

(10) Patent No.: US 11,566,423 B2
(45) Date of Patent: Jan. 31, 2023

(54) LATTICE OF HOLLOW BODIES WITH REINFORCEMENT MEMBER SUPPORTS

(71) Applicant: Plascon Plastics Corporation, Delta (CA)

(72) Inventors: Clark Chow, Surrey (CA); John David Bowick, Port Hope (CA); Jeremy Jonathan Clarke-Ames, Delta (CA)

(73) Assignee: Plascon Plastics Corporation, Delta (CA)

( * ) Notice: Subject to any disclaimer, the term of this patent is extended or adjusted under 35 U.S.C. 154(b) by 0 days.

(21) Appl. No.: 17/195,241

(22) Filed: Mar. 8, 2021

(65) Prior Publication Data

US 2022/0282480 A1 Sep. 8, 2022

(51) Int. Cl.
*E04B 5/32* (2006.01)
*E04B 5/40* (2006.01)

(52) U.S. Cl.
CPC ..... *E04B 5/328* (2013.01); *E04B 5/40* (2013.01)

(58) Field of Classification Search
CPC ..... E04B 5/328; E04B 5/326; E04B 5/40
See application file for complete search history.

(56) References Cited

U.S. PATENT DOCUMENTS 3,998,204 A 12/1976 Fuchs et al.
5,396,747 A 3/1995 Breuning
5,797,230 A * 8/1998 Lassen ..... E04B 5/326 52/576
6,789,366 B1 * 9/2004 Febra ..... B28B 23/0068 52/576
7,540,121 B2 * 6/2009 Haeussler ..... E04C 5/203 52/577
D639,449 S * 6/2011 Luburic ..... E04B 5/328 D25/1
8,028,485 B2 * 10/2011 Pfeffer ..... E04C 5/0622 52/576
8,322,112 B2 * 12/2012 Luburic ..... E04B 5/328 52/576
8,590,230 B2 11/2013 Stucklin et al.
9,038,352 B2 * 5/2015 Miedzik ..... E04B 5/328 52/745.13
10,196,819 B2 * 2/2019 Miedzik ..... E04C 5/20
(Continued)

FOREIGN PATENT DOCUMENTS

FR 2125534 9/1972
JP 2003171994 6/2003
(Continued)

OTHER PUBLICATIONS

Parkins, Sid, "Maybe 'Shade Balls' Should not be Balls," Science New for Students, Jun. 1, 2017 (https://www.sciencenewsforstudents.org/article/maybe-shade-balls-should-not-be-balls#:~:text=Teen's%20tests%20suggest%20a%2012,sides%2C%20a%20new%20study%20finds.) last accessed on Feb. 23, 2021.
(Continued)

*Primary Examiner* — Andrew J Triggs
(74) *Attorney, Agent, or Firm* — Ganz Pollard, LLC

(57) ABSTRACT

A lattice of hollow bodies for forming a concrete floor slab comprises a plurality of hollow bodies. Each of the hollow bodies is coupled to an adjacent other one of said hollow bodies. Each of the hollow bodies has an outwardly extending reinforcement support for receiving a reinforcement member.

23 Claims, 16 Drawing Sheets

(56) References Cited

U.S. PATENT DOCUMENTS

| | | | | |
|---|---|---|---|---|
| 10,344,477 | B2 * | 7/2019 | Levinton | E04C 5/162 |
| 10,753,088 | B2 * | 8/2020 | Mirkhani | E04B 7/00 |
| 2005/0138877 | A1 | 6/2005 | Inoue et al. | |
| 2007/0199254 | A1 * | 8/2007 | Luburic | E04B 5/328 52/80.1 |
| 2009/0165420 | A1 * | 7/2009 | Pfeffer | E04C 5/0622 249/188 |
| 2010/0122504 | A1 | 5/2010 | Sarkisian et al. | |
| 2011/0294394 | A1 | 12/2011 | Nelson et al. | |
| 2012/0200004 | A1 * | 8/2012 | Levinton | E04C 5/04 264/273 |
| 2013/0036693 | A1 * | 2/2013 | Lee | E04B 5/326 264/261 |
| 2013/0121766 | A1 | 5/2013 | Birger | |
| 2013/0212974 | A1 | 8/2013 | Sullivan | |
| 2016/0108633 | A1 | 4/2016 | Mohammadi et al. | |
| 2018/0002930 | A1 | 1/2018 | Miedzik et al. | |
| 2021/0317659 | A1 * | 10/2021 | Mirkhani | E04B 5/326 |

FOREIGN PATENT DOCUMENTS

| | | |
|---|---|---|
| JP | 2004132004 | 4/2004 |
| JP | 2004176309 | 6/2004 |
| JP | 2004244938 | 9/2004 |
| JP | 2005146721 | 6/2005 |
| JP | 2005188265 | 7/2005 |
| JP | 3701196 | 9/2005 |
| JP | 2005282010 | 10/2005 |
| JP | 2006089994 | 4/2006 |
| JP | 2006138166 | 6/2006 |
| JP | 3877686 | 2/2007 |
| JP | 2007032055 | 2/2007 |
| JP | 3904216 | 4/2007 |
| JP | 3911462 | 5/2007 |
| JP | 4312110 | 8/2009 |
| JP | 2009191542 | 8/2009 |
| JP | 4418961 | 12/2009 |
| JP | 2011220036 | 11/2011 |
| KR | 201000083035 | 7/2010 |
| WO | 2002092935 | 11/2002 |
| WO | 2005080704 | 9/2005 |
| WO | 2010076757 | 7/2010 |
| WO | 2010132900 | 11/2010 |
| WO | 2014058308 | 4/2014 |
| WO | 2014079741 | 5/2014 |
| WO | 2015182817 | 12/2015 |
| WO | 2015184476 | 12/2015 |
| WO | 2019148300 | 8/2019 |

OTHER PUBLICATIONS

Chown, Marco, "Shade Balls—Just Add Water," Press Reader, Nov. 12, 2016, (https://www.pressreader.com/canada/toronto-star/20161112/282952449774508), last accessed on Feb. 23, 2021.

Howard, Brian Clark, "Why Did L.A. Drop 96 Million 'Shade Balls' Into its Water," National Geographic, Aug. 12, 2015, (https://www.nationalgeographic.com/science/article/150812-shade-balls-los-angeles-California-drought-water-environment#:~:text=Why%20Did%20L.A.%20Drop%2096,Shade%20Balls'%20Into%20Its%20Water%3F&text=The%20Los%20Angeles%20Department%20of,evaporation%20and%20deter%20algal%20growth.&text=Please%20be%20respectful%20of%20copyright), last accessed on Feb. 23, 2021.

International Search Report and Written Opinion for PCT Application No. PCT/CA2019/050148, dated Apr. 26, 2019, 8 pages.

International Preliminary Report for PCT Application No. PCT/CA2019/050148, dated Aug. 11, 2020, 6 pages.

International Search Report and Written Opinion for PCT Application No. PCT/CA2022/050326, dated May 18, 2022, 10 pages.

* cited by examiner

LATTICE OF HOLLOW BODIES WITH REINFORCEMENT MEMBER SUPPORTS

FIELD

The present disclosure relates to a lattice of hollow bodies and, in particular, to a lattice of hollow bodies for use in the construction of reinforced concrete floor slabs.

BACKGROUND

U.S. Pat. No. 5,396,747 which issued on Mar. 14, 1995, to Breuning et al. discloses plane, hollow, reinforced concrete floor slabs with two-dimensional structure and method for their production. Constructions developed by this technique will vary widely and with considerable profit replace conventional floor structures. The technique makes it possible to choose higher strength and stiffness, less volume of materials, greater flexibility, better economy or an arbitrary combination of these gains. The technique makes it possible to create a total balance between bending forces, shear forces and stiffness (deformations) so that all design conditions can be fully optimized at the same time. The technique presents a distinct minimized construction characterized by the ability that concrete can be placed exactly where it yields maximum capacity. The technique offers material and cost savings compared with the conventional compact two-way reinforced slab structure. The technique is suitable for both in situ works and for prefabrication.

International Patent Application Number PCT/CA2019/050148 discloses a structure where a plurality of hollow bodies are connected together in a lattice-like arrangement which is embedded in a concrete slab.

SUMMARY

A lattice of hollow bodies for forming concrete floor slab comprises a plurality of hollow bodies, wherein each of the hollow bodies is coupled to at least one adjacent other of said hollow bodies, each of said hollow bodies having at least one outwardly extending support projection for receiving at least one reinforcement member.

In one example a first plurality of the hollow bodies has a first plurality of support projections which are linearly aligned in a first direction for receiving a first plurality of straight reinforcement members extending in the first direction and a second plurality of support projections which are linearly aligned in a second direction, which is perpendicular to the first direction, and receive a second plurality of straight reinforcement members which are perpendicular to the first plurality of straight reinforcement members.

A method of casting concrete floor slabs, comprising the steps of providing a lattice of hollow bodies, a plurality of the hollow bodies having at least one outwardly extending support projection;

placing the lattice in a form; positioning a reinforcement member in at least one of the support projections of the plurality of the hollow bodies; pouring concrete into the form to encompass the lattice of hollow bodies; and allowing the concrete to set.

A concrete floor slab is manufactured by a method comprising the steps of providing a lattice of hollow bodies, a plurality of the hollow bodies having at least one outwardly extending support projection; placing the lattice in a form; positioning a reinforcement member in at least one of the support projections of the plurality of the hollow bodies; pouring concrete into the form to encompass the lattice of hollow bodies; and allowing the concrete to set.

BRIEF DESCRIPTION OF THE DRAWINGS

The concepts described herein will be more readily understood from the following description of the embodiments thereof given, by way of example only, with reference to the accompanying drawings, in which.

DETAILED DESCRIPTION

Figure 1:
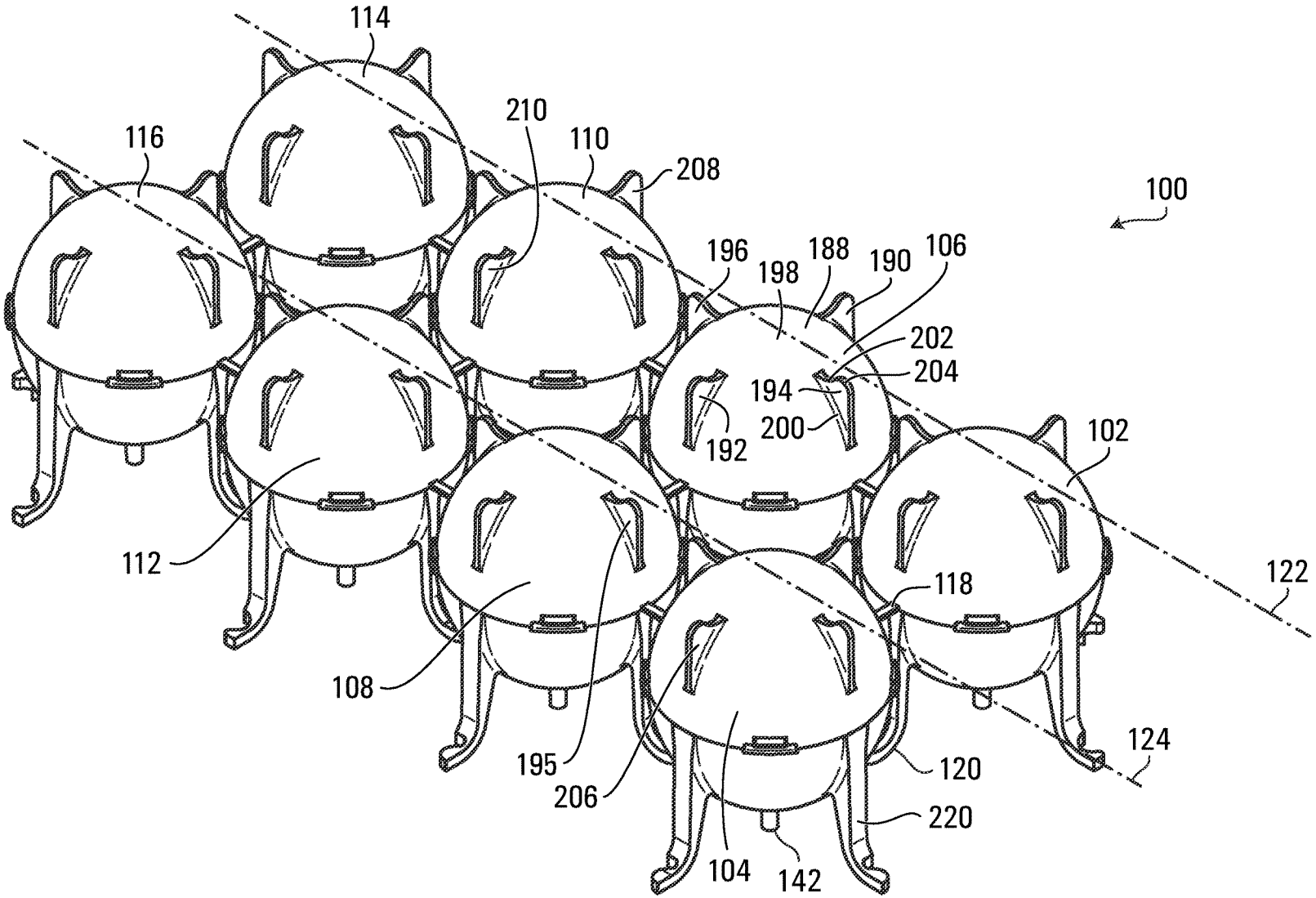
FIG. 1 is a top, front isometric view of a lattice of hollow bodies for use in the construction of reinforced concrete floor slabs.
Figure 2:
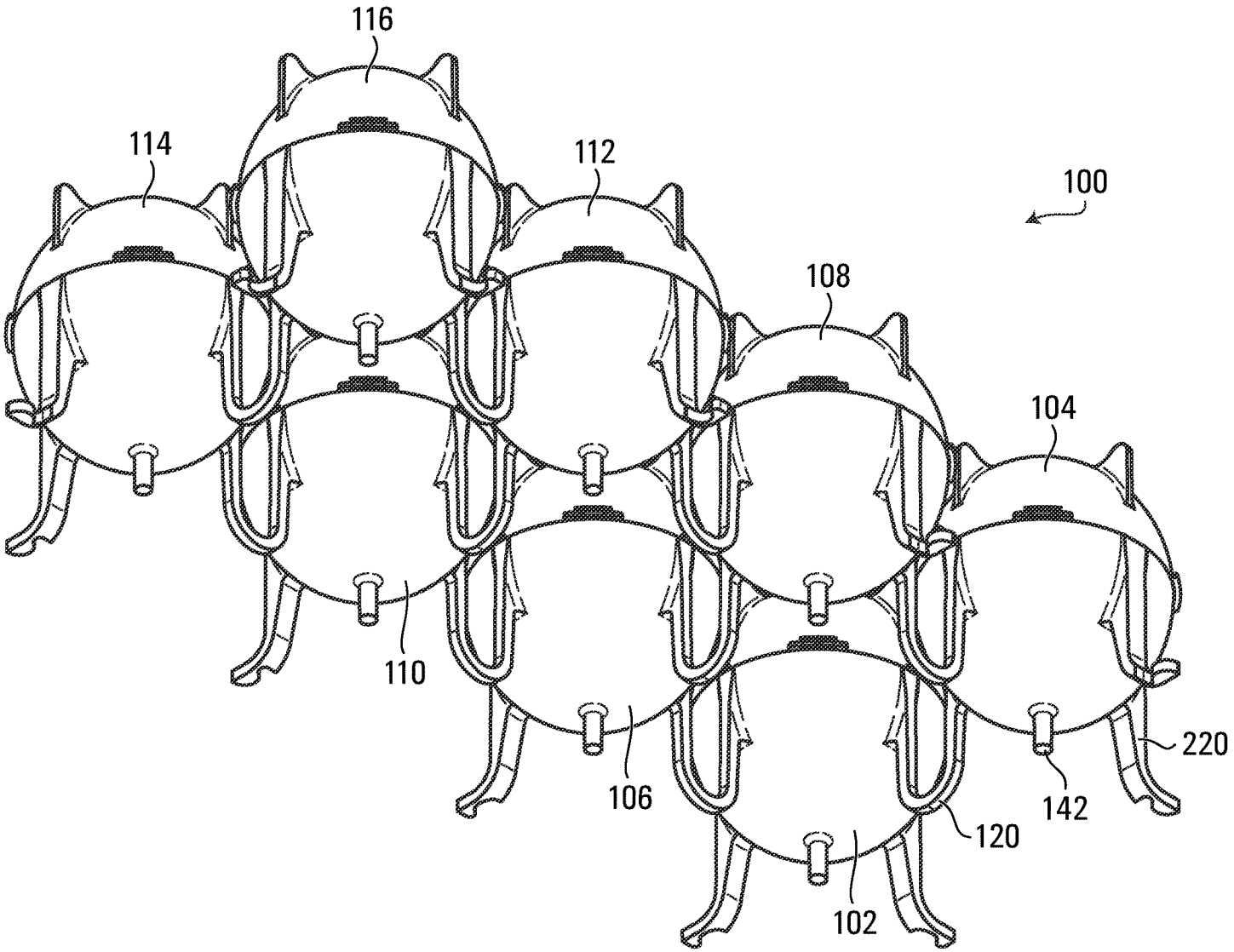
FIG. 2 is a bottom, rear isometric view of the lattice of hollow bodies of FIG. 1.
Figure 3:
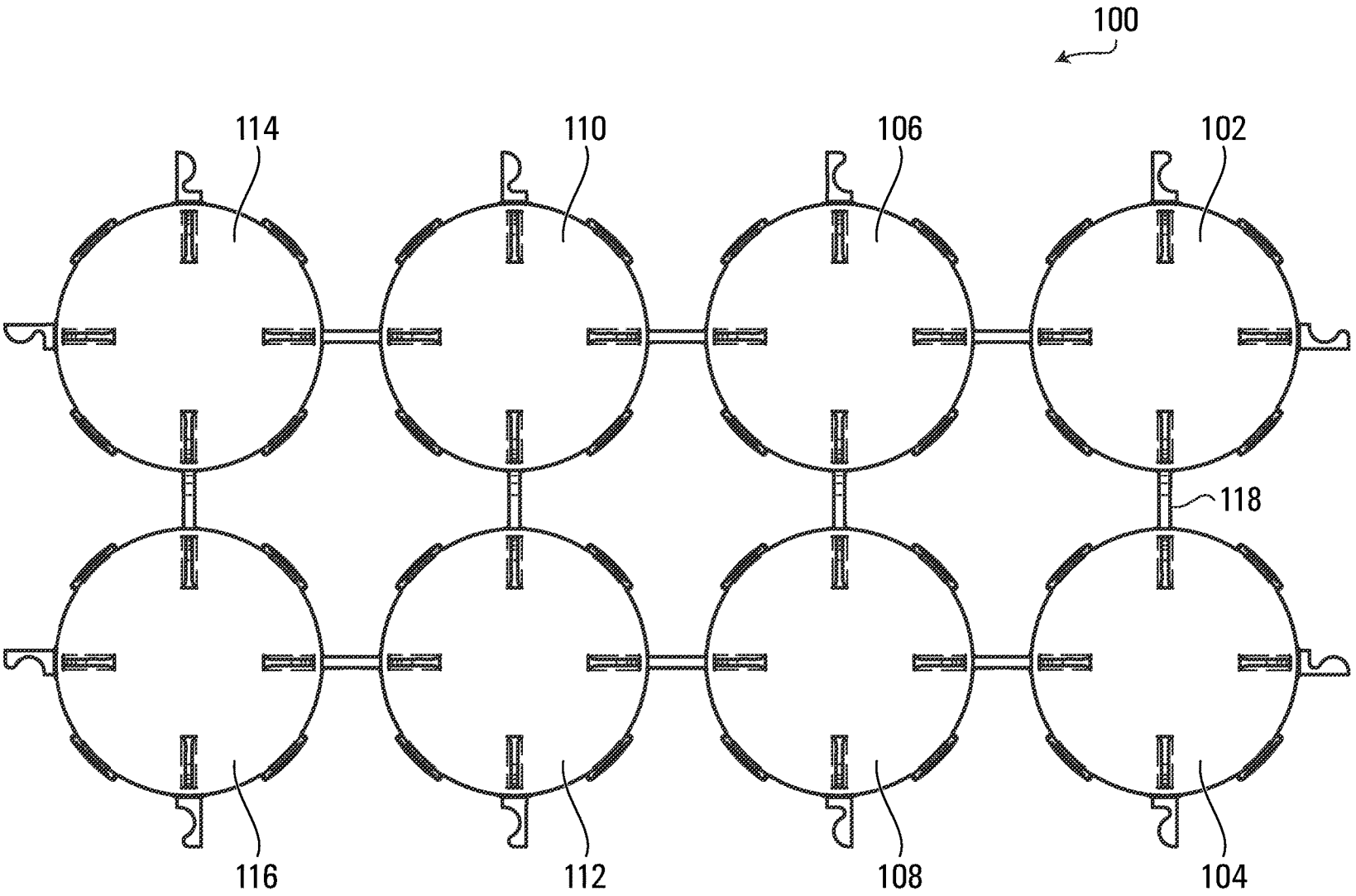
FIG. 3 is a top plan view thereof.
Figure 4:
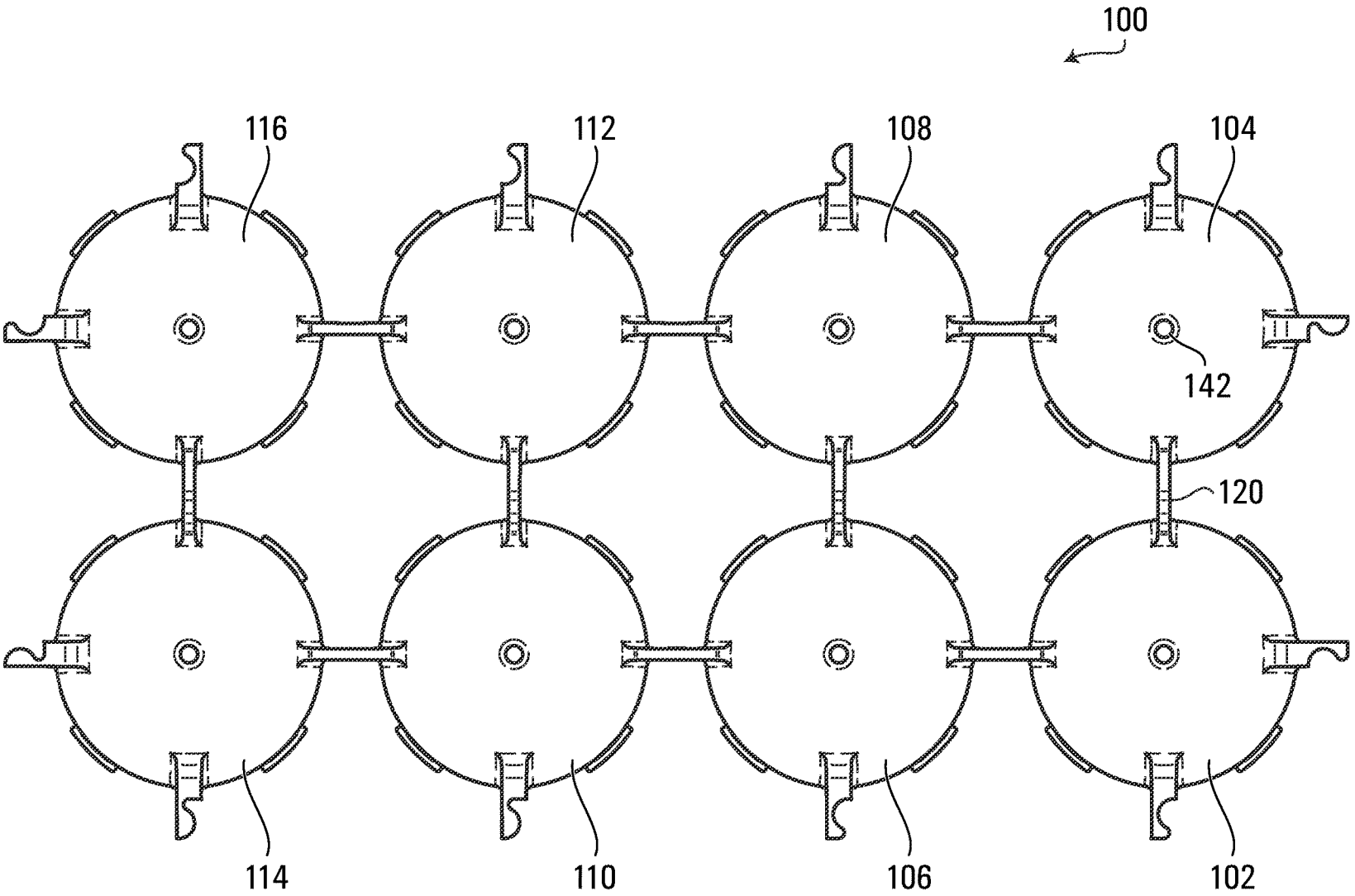
FIG. 4 is a bottom plan view thereof.
Figure 5:
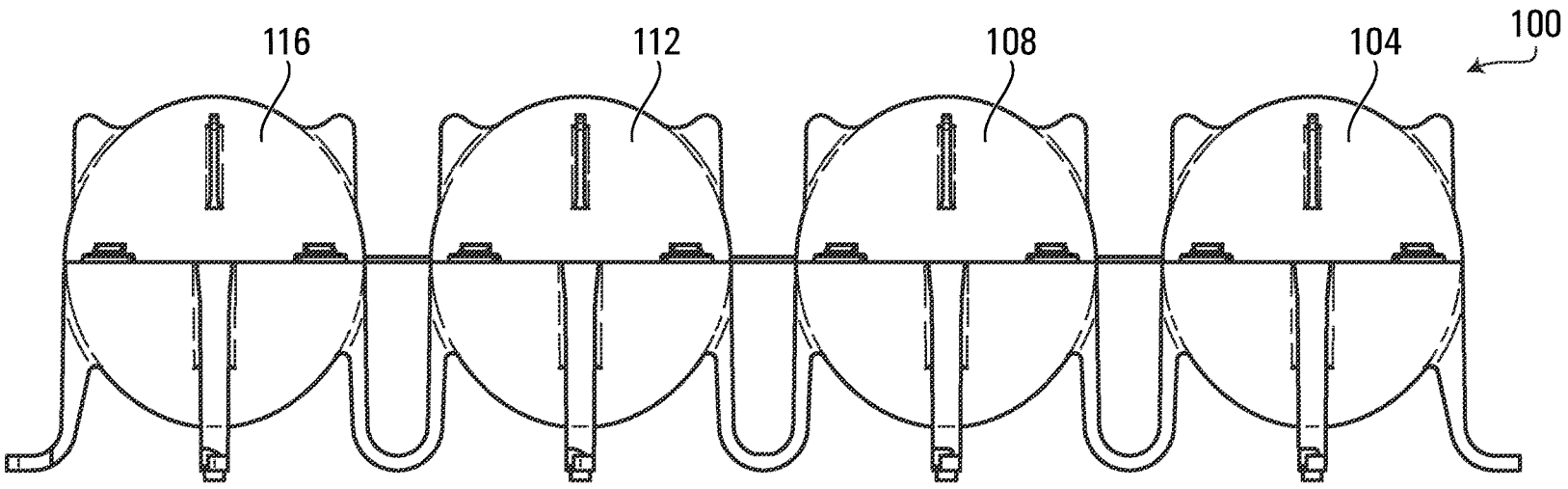
FIG. 5 is a side elevation view thereof.
Figure 6:
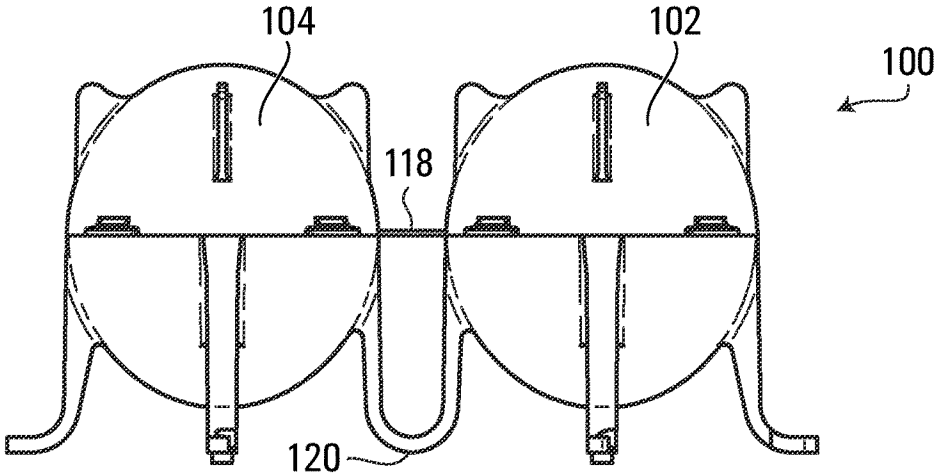
FIG. 6 is a end view thereof.
Figure 17:
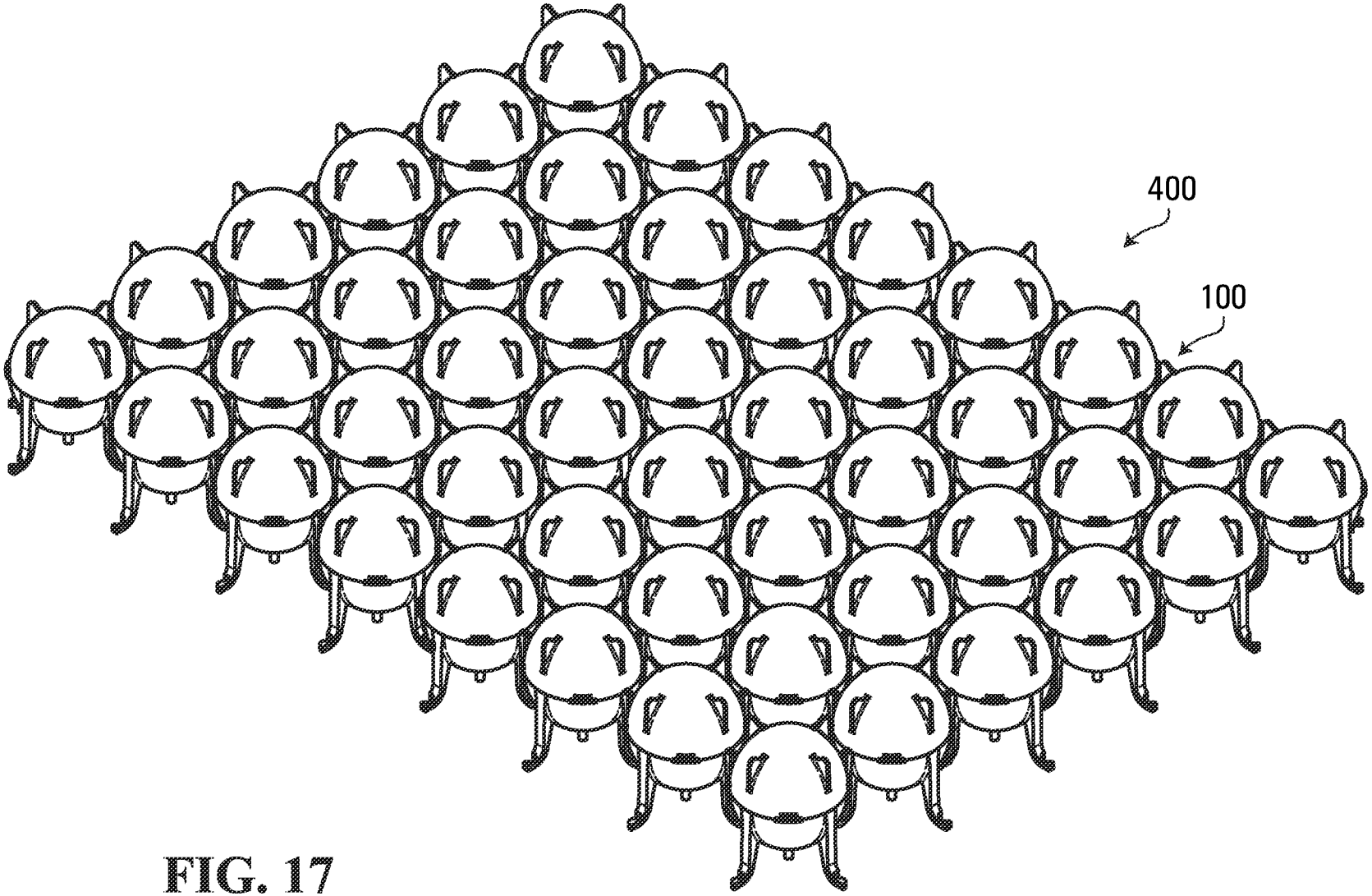
FIG. 17 is an isometric view of an assembly comprising six of the lattices of FIG. 1.

FIGS. 1 and 2 are, respectively, a top, front isometric view and a bottom, rear isometric view of a lattice 100 of hollow bodies, eight in this example, namely hollow bodies 102, 104, 106, 108, 110, 112, 114 and 116. Each of the hollow bodies is coupled to at least one adjacent one of said hollow bodies by two integral connectors, as shown in FIGS. 1 and 2, in which, for example, a first hollow body 102 is coupled to the second hollow body 104 by top integral connector 118 and bottom integral connector 120. The first hollow body 102 is likewise coupled to the third hollow body 106 in a similar manner. The hollow bodies are linearly aligned in this example. For example, hollow bodies 102, 106, 110 and 114 are aligned along straight line 122, while hollow bodies 104, 108, 112 and 116 are aligned along straight line 124 in this example. As described thus far, the lattice is generally similar to the first embodiment of the lattice described in my earlier International Patent Application Number PCT/CA2019/050148. In this example, the lattice of hollow bodies is a lattice of two by four generally spherical hollow bodies. However, in other examples, the lattice of hollow bodies may be any suitable shape, configuration and number of hollow bodies. A typical lattice for normal usage would have many more spherical bodies than illustrated and could be formed by a plurality of similar lattices connected together as shown by lattices 100 and 300 of FIG. 15 and assembly 400 of 48 hollow bodies as shown in FIG. 17.

Figure 7:
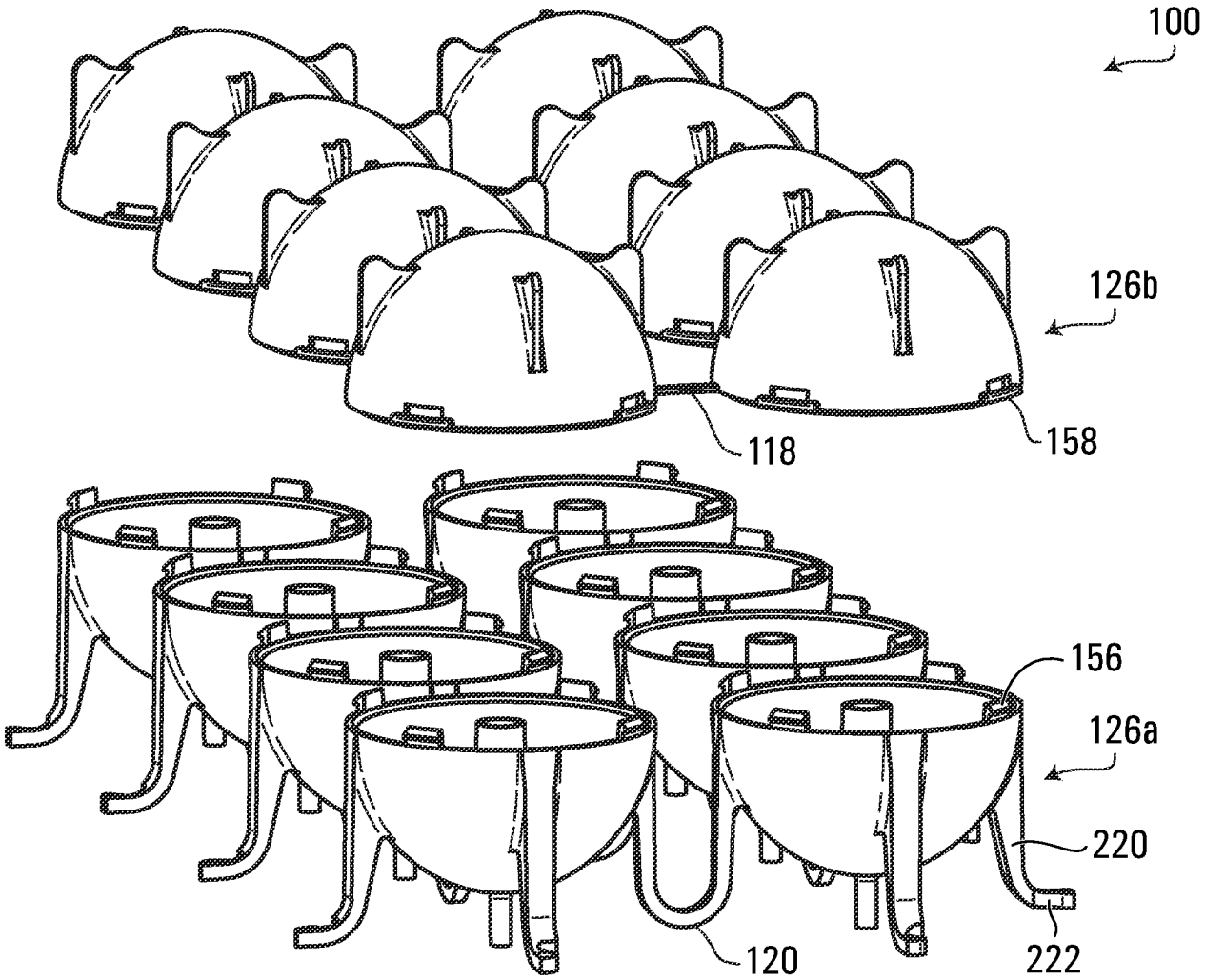
FIG. 7 is an exploded top, front isometric view of the lattice of FIG. 1.

Referring now to FIG. 7, the lattice 100 of hollow bodies in this example is of a thermoplastic and is manufactured by injection moulding a first portion 126*a* of the lattice 100 of hollow bodies, a bottom portion in this example, and injection moulding a second portion 126*b* of the lattice 10 of hollow bodies, a top portion thereof. The injection molding may be done with various materials such as polyethylene, polypropylene, recycled materials, and fillers (up to 80%). Injection molding may be done at temperatures between 160 degrees Celsius and 280 degrees Celsius. However other materials and methods of manufacture could be used for other embodiments.

Figure 8:
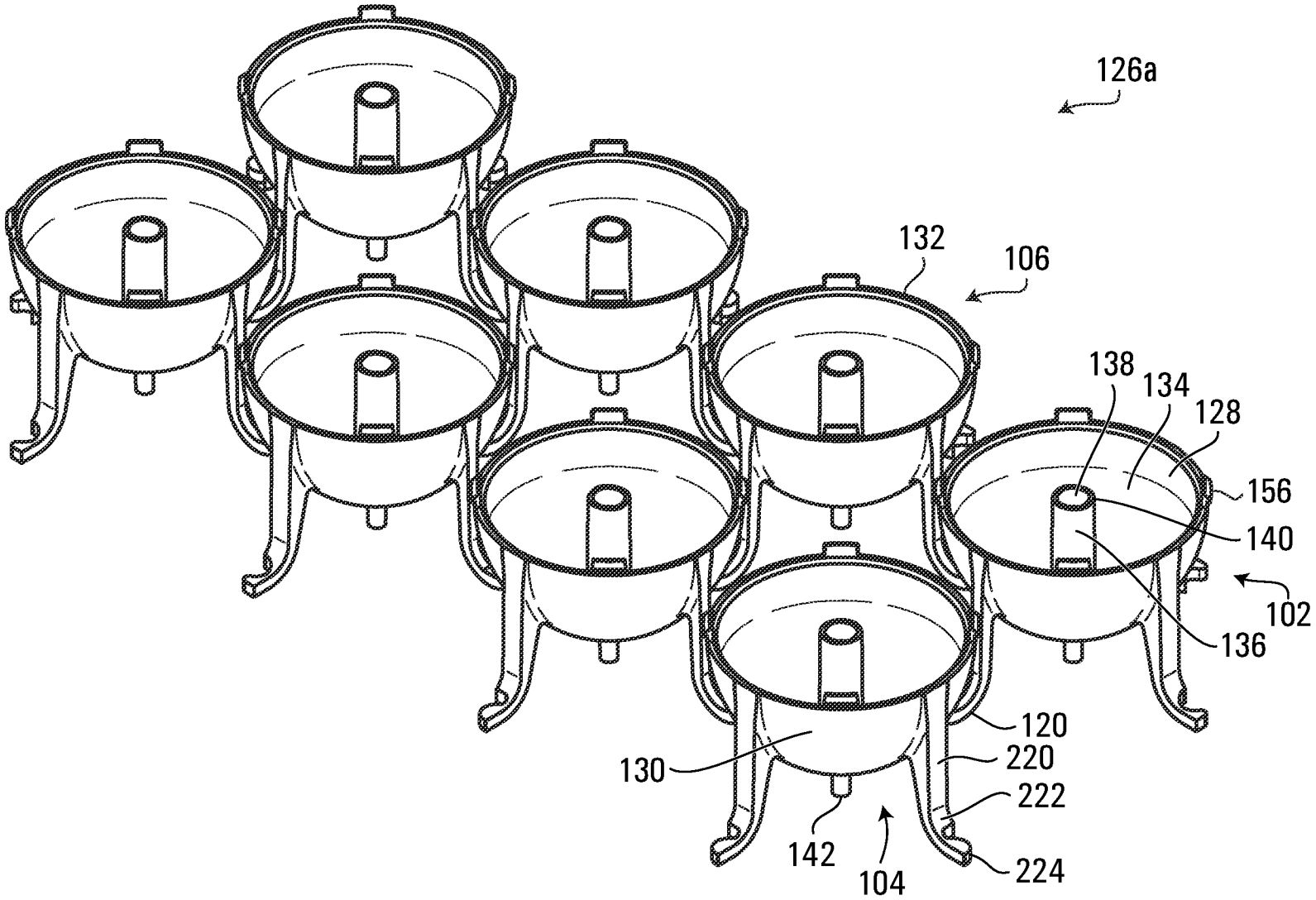
FIG. 8 is a top, front isometric view of the bottom portion thereof.

The first portion 126*a* of the lattice of hollow bodies is shown in greater detail in FIG. 8 and includes a plurality of bottom half spherical portions of the hollow bodies, including a bottom half spherical portion 128 of the first hollow body 102, a bottom half spherical portion 130 of the second hollow body 104, and a bottom half spherical portion 132 of the third hollow body 106. Each of the bottom half spherical portions of the hollow bodies is coupled to at least one adjacent one of said bottom half spherical portions by an integral connector in this example. FIG. 8 shows the bottom half spherical portion 128 of the first hollow body 102 coupled to the bottom half spherical portion 130 of the second hollow body 104 by the bottom integral connector 120. In this example, the bottom integral connectors are U-shaped and are formed between bottom half spherical portions of the hollow bodies as the first half 126*a* of the lattice is injection moulded. The bottom half spherical portion 128 of the first hollow body 102 is likewise coupled to the bottom half spherical portion 132 of the third hollow body 106 in a similar manner. The bottom half of each of the spherical portions has a semispherical, hollow interior 134 and a central, hollow, cylindrical projection 136 having a circular opening 138 adjacent top end 140 thereof. Each of the bottom half spherical portions of the hollow bodies also includes on its exterior an outwardly extending central leg. For example, hollow body 104 includes central leg 142. A height of each of the central legs may be adjustable.

Figure 9:
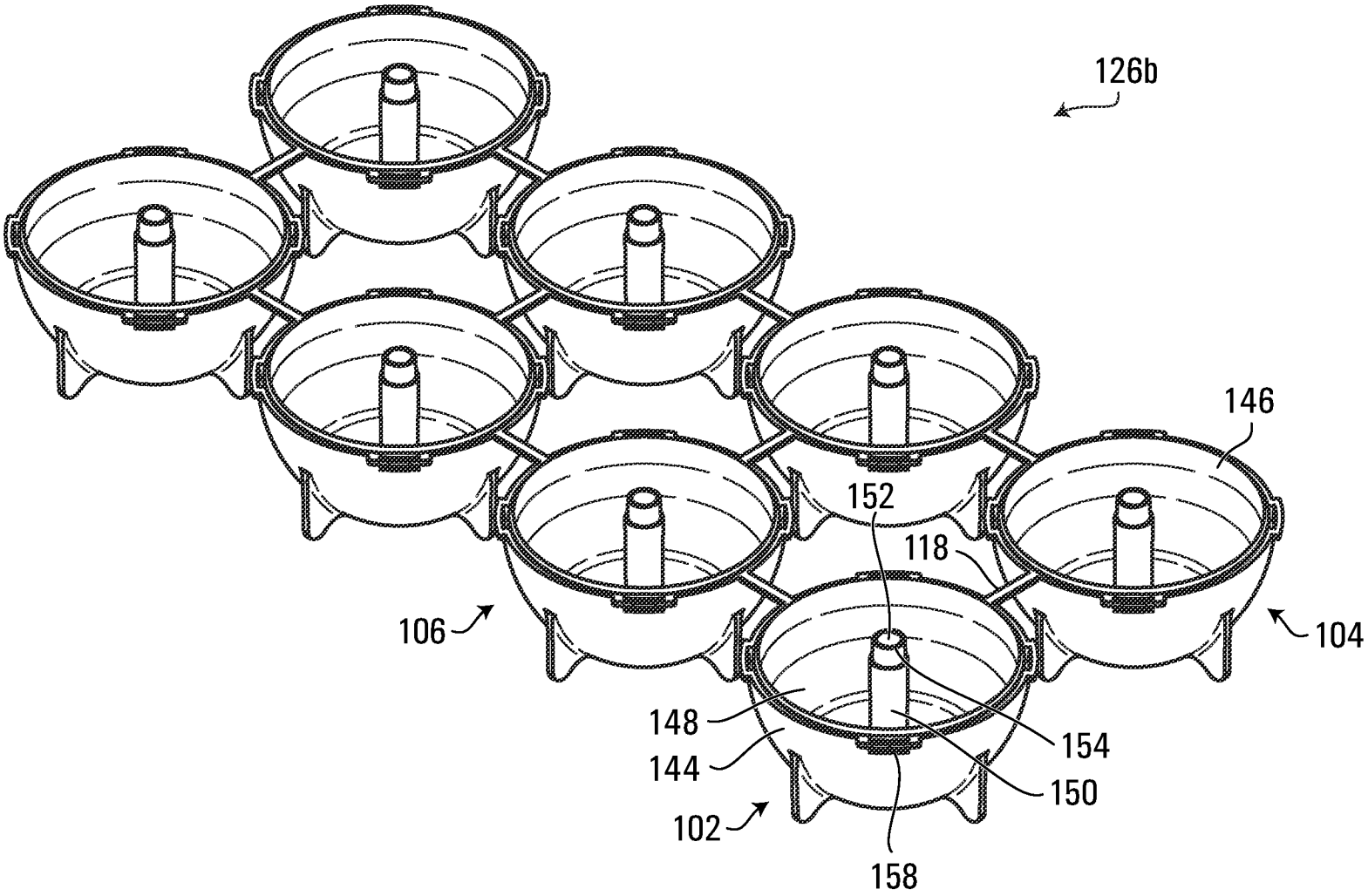
FIG. 9 is a bottom, front isometric view of the top portion thereof.
Figure 10:
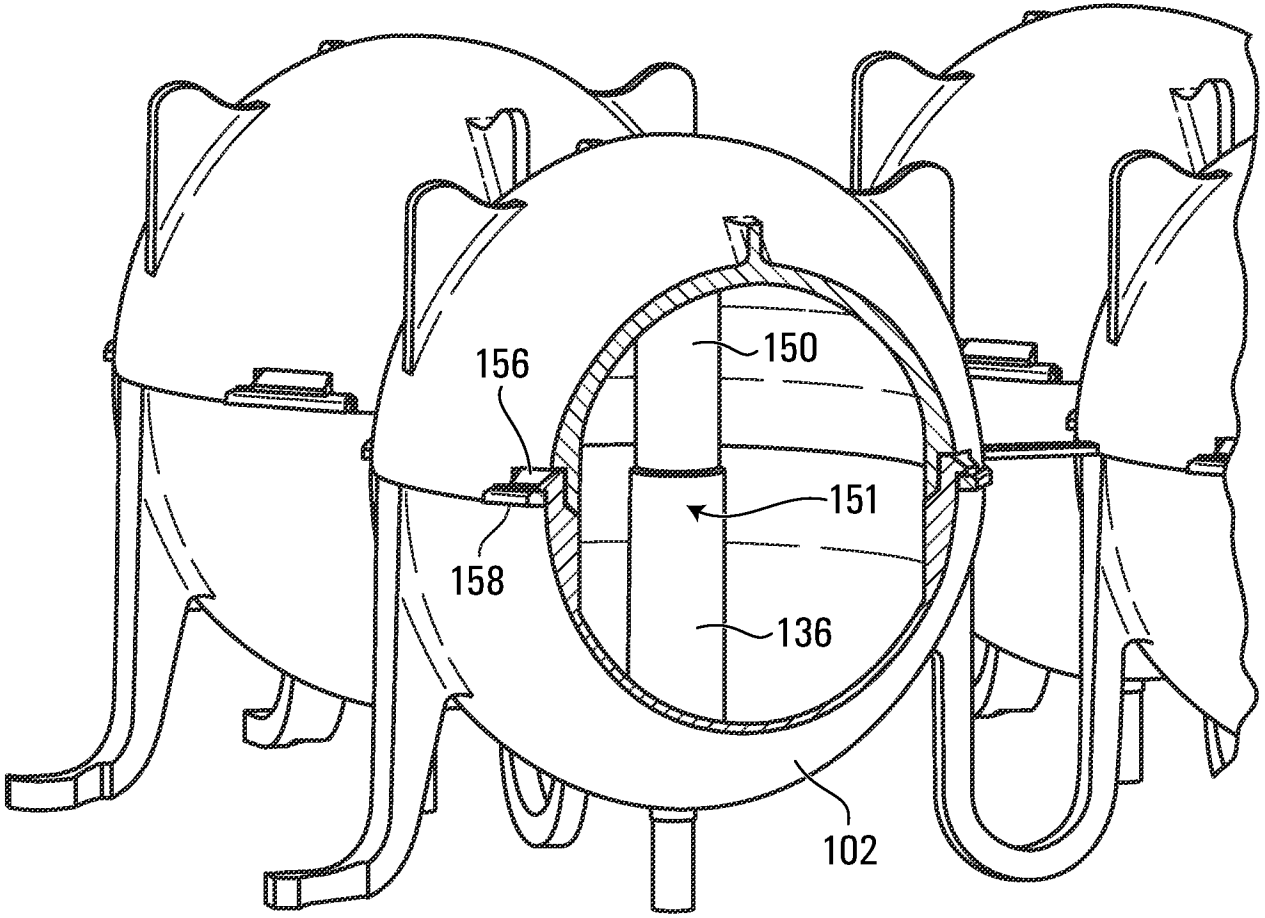
FIG. 10 is a fragmentary, isometric view of the lattice with a side of one of the hollow bodies cut away to show the interior thereof.

The second portion 126*b* of the lattice 100 of hollow bodies, a top portion in this example, is substantially similar in structure to the first portion 126*a* of the lattice 100 of hollow bodies as seen in FIG. 9. In this case, however, top integral connectors are straight connectors connecting adjacent top half spherical portions. For example, the top integral connector 118 connects top half spherical portion 144 of the hollow body 102 to top half spherical portion 146 of hollow body 104. The top half of each of the spherical portions has a semispherical, hollow interior 148 and a central, hollow, cylindrical projection 150 having a circular opening 152 adjacent bottom end 154 thereof. The cylindrical projection 150 of each of the top portions of the hollow bodies shown in FIG. 9 is adapted to fit tightly within the circular opening 138 of the cylindrical projection 136 of one of the bottom portions of the hollow bodies when the top portions and bottom portions are fitted together. When fitted together, cylindrical projections 150 and 136 of each hollow body form a vertical post-like internal support 151 which acts as an internal support for each hollow body when the lattice is positioned for use, as can be seen in FIG. 10.

Figure 11:
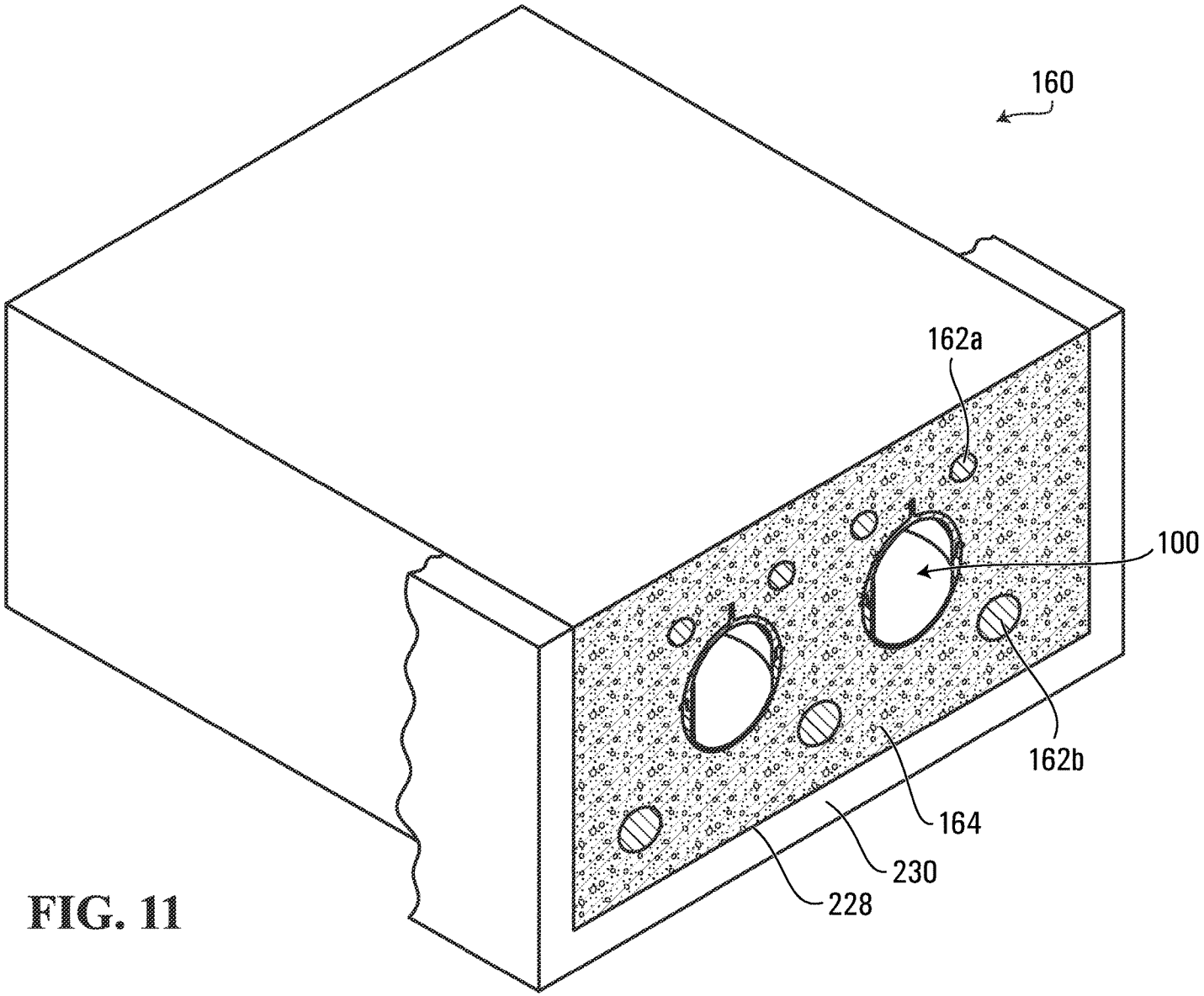
FIG. 11 is a front, top isometric view of a floor slab having the lattice of FIG. 1 and reinforcement members embedded in concrete, the slab being shown partly in section and mounted within a concrete form shown in fragment.
Figure 12:
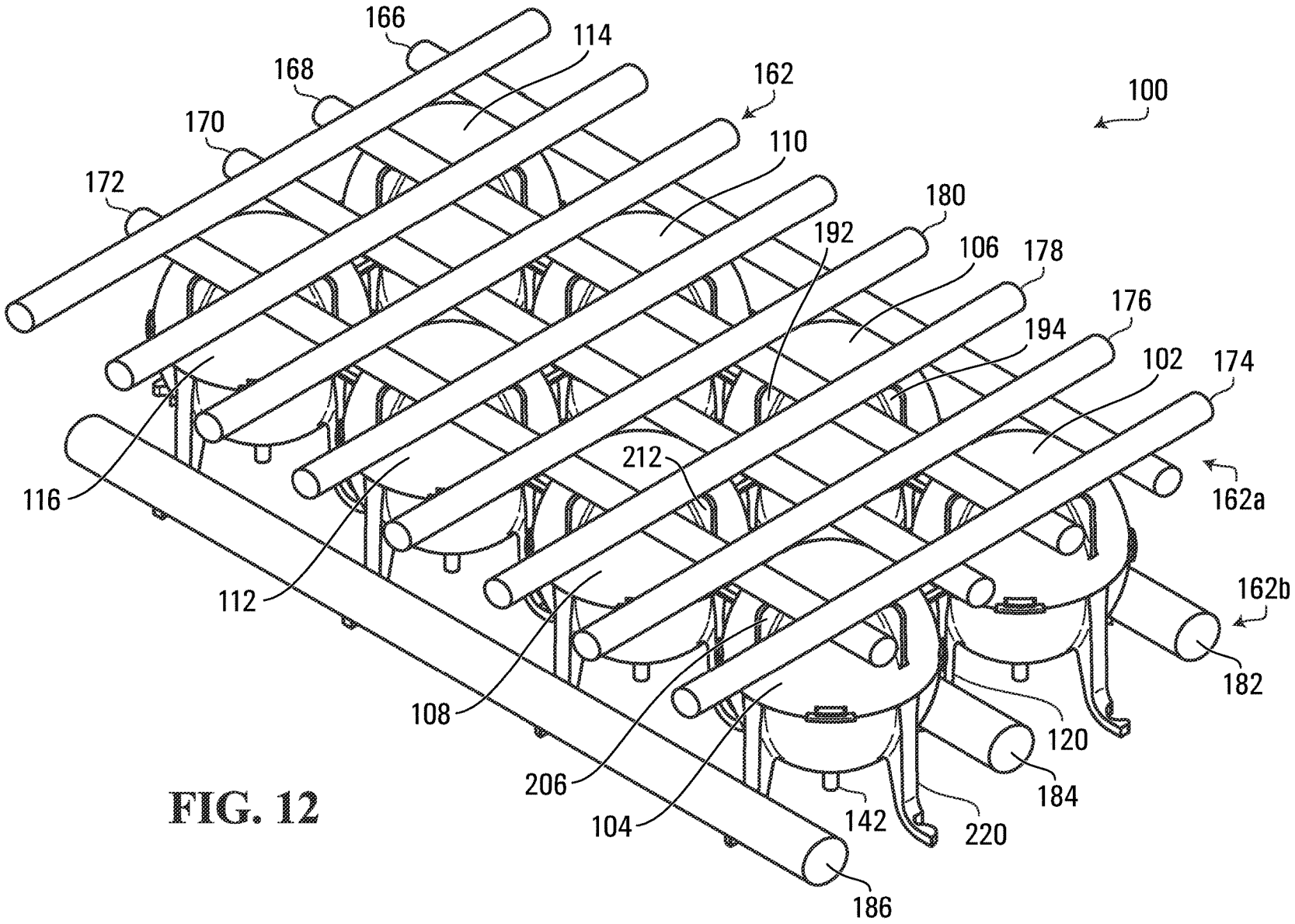
FIG. 12 is a side, front isometric view of the lattice of FIG. 1 with reinforcement members mounted thereon.

The first portion 126*a* of the lattice 100 of hollow bodies and the second portion 126*b* of the lattice 100 of hollow bodies are connected together to form the lattice 100 of hollow bodies. The first portion 126*a* of the lattice 100 of hollow bodies and the second portion 126*b* of the lattice 100 of hollow bodies are connected together by bottom clasp fastener 156 and top clasp fastener 158 shown in FIGS. 7, 8, 9, and 10, although they may be heat sealed together or sealed together with an adhesive or other means. The lattice 100 of hollow bodies may be used to manufacture a reinforced concrete slab 160, as shown in FIG. 11, by retaining the lattice 100 of hollow bodies between a first reinforcement layer 162*a* and a second reinforcement layer 162*b* of a reinforcement assembly 162, as shown in FIG. 12, prior to casting the lattice of hollow bodies in concrete 164, best shown in FIG. 11, to form the concrete slab 160. Referring back to FIG. 12, in this example the first reinforcement layer 162*a* is a plurality of criss-crossing steel reinforcement bars, for example, steel reinforcement bars 166, 168, 170, and 172 and steel reinforcement bars 174, 176, 178, and 180. The second reinforcement layer 162*b* is comprised of a plurality of parallel reinforcement bars, for example, bars 182, 184, and 186 as shown in FIG. 12.

Referring back to FIG. 1, each of the hollow bodies, for example hollow body 106, includes a plurality of generally triangular projections which, in this example, are integrally formed with its top half spherical portion 188. For example, hollow body 106 has four projections 190, 192, 194 and 196 adjacent its top 198. Each of the projections, for example projection 194, includes a concave edge 200 where it merges with the rest of the top half spherical portion 188 and a concave edge 202 adjacent vertex 204 thereof. The concave edge 202 faces upwardly when the lattice 100 is positioned for use. In this particular example, there are four triangular projections which are arranged 90° apart on each of the hollow bodies. The triangular projections 190, 192, 194 and 196 may support one or more reinforcement bars, or other types of reinforcement members, and are thus also referred to herein as support projections or reinforcement bar supports. For example, triangular projection 192 serves as a support for reinforcement bar 168 of reinforcement layer 162*a* shown in FIG. 12. The reinforcement layer 162*a* includes a plurality of reinforcement bars 166, 170, and 172 which are parallel to reinforcement bar 168. These bars are also supported by additional triangular projections on other hollow bodies, for example reinforcement bar 172 is supported by triangular projection 206 of hollow body 104. Referring again to FIG. 1, corresponding projections on adjacent hollow bodies are linearly aligned, for example projections 190 and 192 on hollow body 106 are linearly aligned respectively with projections 208 and 210 on hollow body 110 and are parallel to line 122. Likewise projection 194 of hollow body 106 is linearly aligned with projection 195 of hollow body 108 in a direction perpendicular to the line 122.

Referring back to FIG. 12, the reinforcement layer 162*a* also includes a plurality of reinforcement bars extending perpendicular to the bars 166-172, for example reinforcement bars 174-180, which rest on top of bars 166-172. They may be held in place temporarily by wire prior to pouring concrete to form the slab as described below. Alternatively, the bars 174-180 could rest on other triangular projections. For example, bar 178 could be supported by linearly aligned projections 194 and 212. In this case the reinforcement bars 166-172 also would rest on top of the bars running perpendicular thereto including bars 174-180.

The reinforcement layer 162*b*, shown in FIGS. 11 and 12, includes reinforcement bars which extend between the hollow bodies, such as reinforcement bar 184 shown in FIG. 12. These bars rest on the U-shaped bottom integral connectors which connect the spherical portions of the hollow bodies together, as shown for bottom integral connector 120 and reinforcing bar 184 in FIG. 12. Similar bottom integral connectors 214 support reinforcing bars perpendicular to bar 184 as shown for reinforcing bar 216 in FIG. 13. That is, like the triangular projections integrally formed with the top half spherical portions, the bottom integral connectors may also generally serve to support one or more reinforcement bars and may thus also be referred to herein as support projections or reinforcement bar supports.

Figure 13:
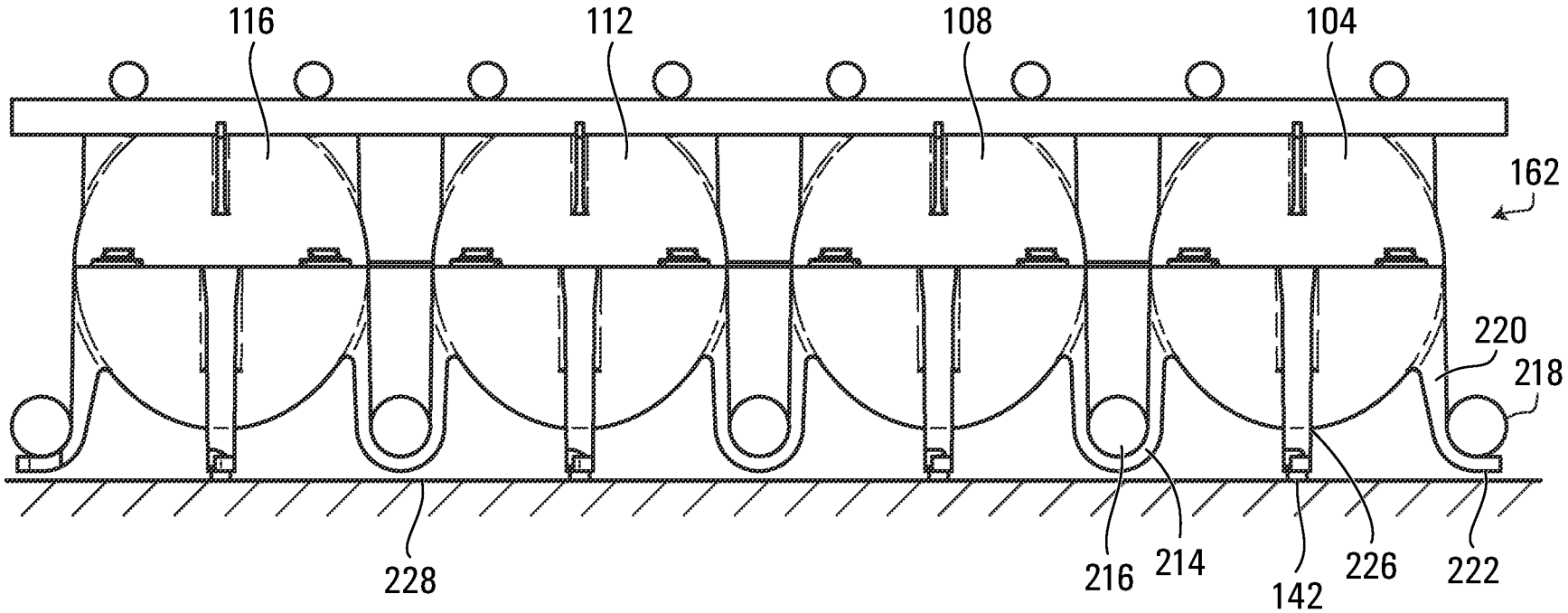
FIG. 13 is a side elevation view thereof.

The lattice also has additional, leg-like reinforcement supports 220 as seen, for example in FIGS. 1, 7, 12, and 13 on the hollow bodies which form the outer sides of the lattice 100. These supports are generally J-shaped with an outwardly extending foot 222 as seen in FIG. 13. These supports extend downwardly the same amount as the U-shaped connectors, such as connector 120, and accordingly provide additional support for the reinforcement members, such as reinforcement bar 218 which rests on foot 222 of the support 220 as shown in FIG. 13.

Figure 14:
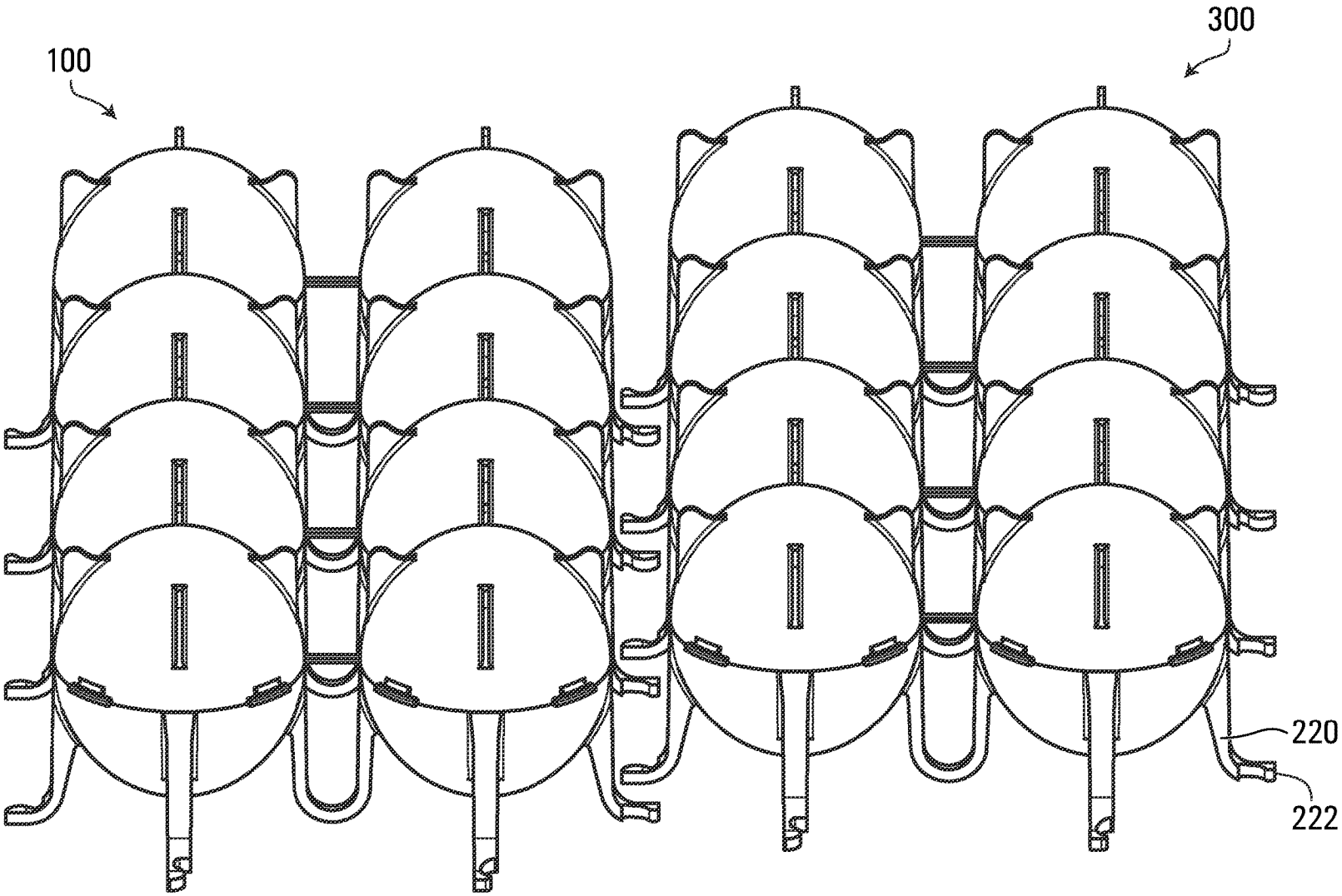
FIG. 14 is an isometric view of the lattice of FIG. 1 positioned adjacent to another, similar lattice of hollow bodies.
Figure 15:
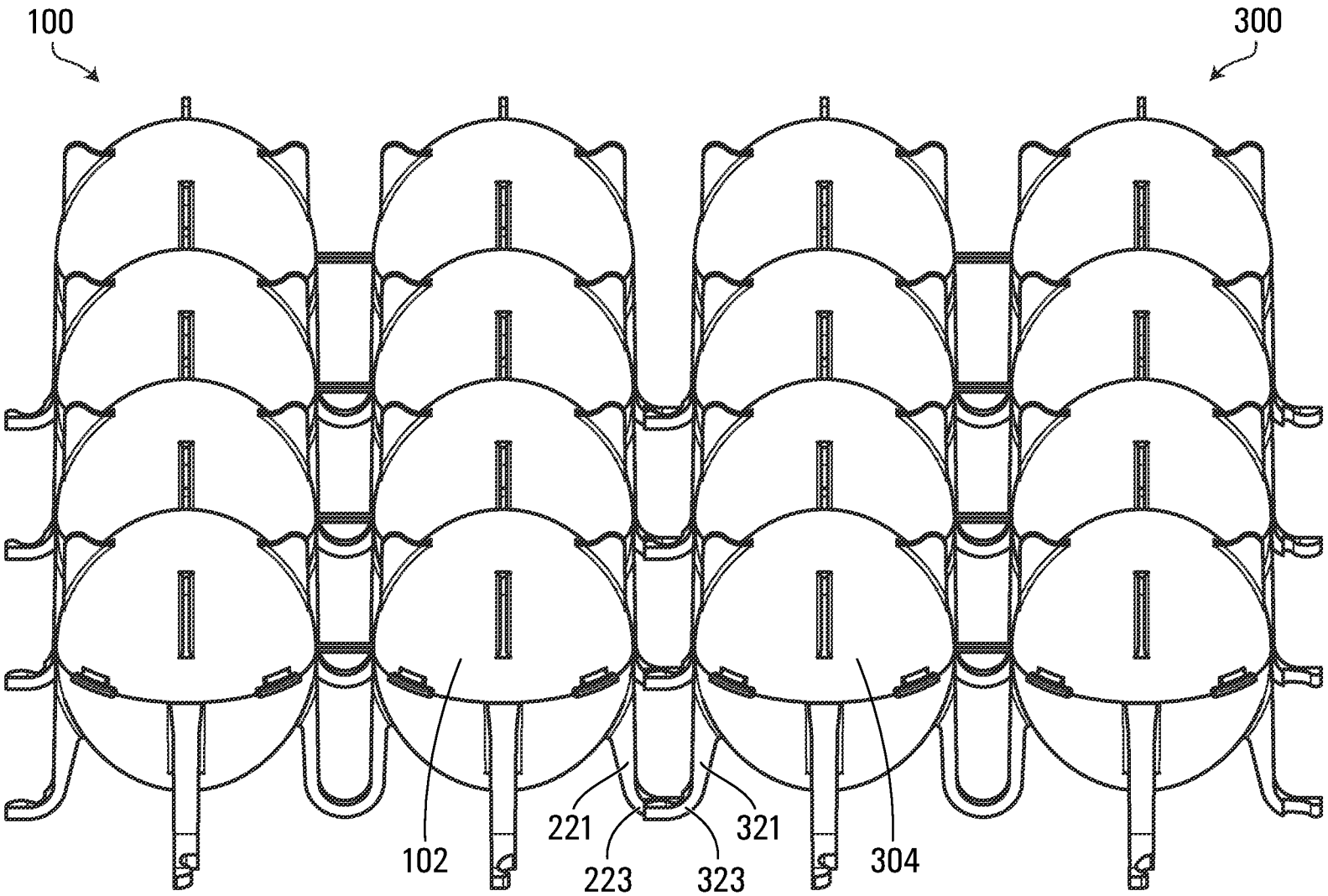
FIG. 15 is an isometric view of an assembly comprising the lattices of FIG. 14.

Referring now to FIGS. 14, and 15, the lattice 100 of hollow bodies may be positioned adjacent to one or more other lattices of hollow bodies. To facilitate such positioning, each outwardly extending foot of the leg-like reinforcement supports 220 has a finger connector, such as finger connector 224 of foot 222, as shown in FIG. 8. The finger connectors serve to help align the lattice 100 of hollow bodies with an adjacent lattice of hollow bodies, such as lattice 300, as shown in FIGS. 14 and 15. The finger connectors of adjacent lattices interlock such as shown for finger connectors 223 and 323 for reinforcement supports 221 and 321 shown for hollow bodies 102 and 304 in FIG. 15. FIG. 17 shows a larger assembly of 48 lattices 400 comprising six of the lattices for example including lattice 100. This assembly would be typical of an assembly of lattices used for making a concrete floor slab.

It may be seen, particularly with reference to FIGS. 12 and 13, that the central legs of the bottom half spherical portions of the hollow bodies, such as central leg 142, extend below the bottoms of the spherical portions of the lattice, such as bottom 226 of the spherical portion of hollow body 104, and therefore support the lattice on a surface, such a surface 228 shown in FIG. 13, prior to pouring concrete over the lattice. This arrangement provides a controlled depth of concrete in the slab below the spherical portions of the hollow bodies after the concrete is poured as seen in FIG. 11. Furthermore, by adjusting the height of the central legs, it is possible to vary the depth of the concrete in the slab below the spherical portions.

Figure 16:
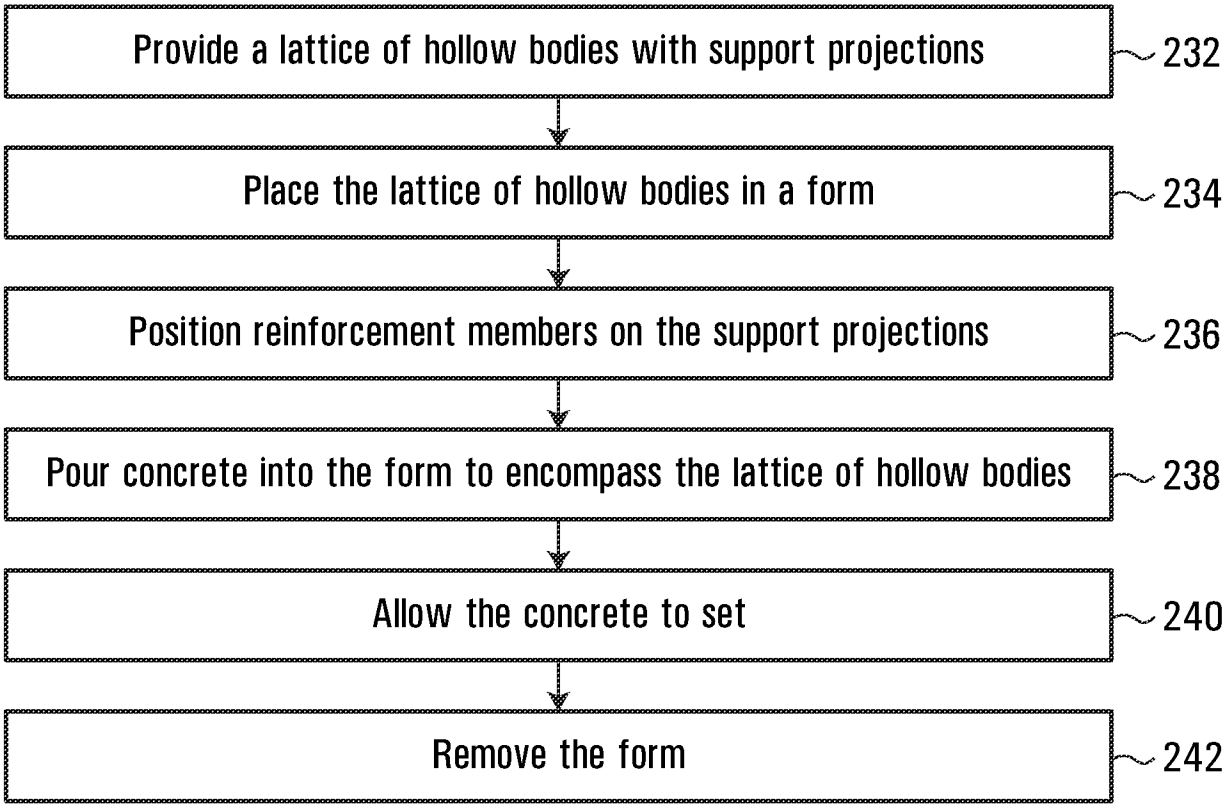
FIG. 16 is a flow chart of the method of making a floor slab using the lattice of FIG. 1 and reinforcement members mounted on supports thereof.

FIG. 16 is a flow chart showing the method of manufacturing the concrete slab 160 shown in FIG. 11. In blocks 232-236, the lattice 100 and reinforcement members are assembled, as shown in FIG. 12, in an appropriately shaped form 230 shown in FIG. 11, prior to pouring the concrete 164. After the reinforcement members have been positioned on the support projections of the lattice, as shown in block 236, concrete is poured into the form to encompass the lattice and the reinforcement members, as shown in block 238. In block 240, the concrete is allowed to set, and finally in block 242 the form is removed from the slab 160.

It will be understood by a person skilled in the art that many of the details provided above are by way of example only, and are not intended to limit the scope of the invention which is to be determined with reference to the following claims.

What is claimed is:

1. An apparatus for use in forming a concrete slab, the apparatus comprising:

a lattice of hollow bodies;

wherein each of the hollow bodies is connected to at least one adjacent other of said hollow bodies, and wherein the hollow bodies are aligned in a two-dimensional array comprising rows and columns perpendicular to each other; and wherein each of the hollow bodies has at least one integrally formed outwardly extending support projection for supporting at least one reinforcement member, the at least one integrally formed outwardly extending support projection including at least one connector extending to an adjacent one of the hollow bodies in the lattice, the at least one connectors thereby directly connecting said adjacent ones of the hollow bodies of the lattice together.

2. The apparatus of claim 1 wherein the lattice comprises a top portion comprised of a two-dimensional array of semi-spherical top portions and a bottom portion comprised of a corresponding two-dimensional array of semi-spherical bottom portions and wherein the top and bottom portions of the lattice are connected together to form the two-dimensional array of hollow bodies.

3. The apparatus of claim 2 wherein the semi-spherical top portions have respective top surfaces and wherein the at least one integrally formed outwardly extending support projection extends outwardly from at least one of the top surfaces.

4. The apparatus of claim 3 wherein the at least one integrally formed outwardly extending support projection comprises a plurality of generally triangular shaped projections.

5. The apparatus of claim 4 wherein the generally triangular shaped projections have concave surfaces for supporting said at least one reinforcement member.

6. The apparatus of claim 5 wherein the generally triangular shaped projections on each semi-spherical top portion include four generally triangular shaped projections spaced apart from each other by 90 degrees about a center axis of said each semi-spherical top portion.

7. The apparatus of claim 4 wherein the generally triangular shaped projections are formed on the semi-spherical top portions to define at least one of rows and columns of support surfaces on the lattice to support the at least one reinforcement member on the lattice.

8. The apparatus of claim 2 wherein the at least one connector is connected between adjacent said semi-spherical bottom portions.

9. The apparatus of claim 2 wherein the at least one connector is oriented and positioned to support said at least one reinforcing member between adjacent semi-spherical bottom portions.

10. The apparatus of claim 2 wherein the at least one integrally formed outwardly extending support projection includes one or more legs extending from the semi-spherical bottom portions and terminating in J-shaped supports for supporting said at least one reinforcement member.

11. The apparatus of claim 10 wherein the J-shaped supports have finger connectors to align and interlock with complementary finger connectors of an adjacent lattice.

12. The apparatus of claim 11 wherein the rows and columns of the hollow bodies include outer rows and outer columns and wherein at least one of the outer rows and outer columns of the hollow bodies has said one or more legs terminating in said finger connectors of the J-shaped supports for connecting the at least one of the outer rows and outer columns of the hollow bodies to corresponding connectors on legs extending from semi-spherical bottom portions of hollow bodies of at least one of an outer row and outer column of the adjacent lattice, for connecting the lattice and the adjacent lattice together.

13. The apparatus of claim 11 wherein the finger connectors have respective top surfaces for supporting said at least one reinforcement member.

14. The apparatus of claim 2 wherein the semi-spherical top portions and the semi-spherical bottom portions comprise respective pluralities of shells.

15. The apparatus of claim 2 wherein the semi-spherical top portions and the semi-spherical bottom portions have first complimentary connectors for connecting said semi-spherical top portions and corresponding semi-spherical bottom portions together to form said lattice.

16. The apparatus of claim 15 wherein said semi-spherical top portions and said semi-spherical bottom portions have axially projecting internal projections having second complimentary connectors that engage when said semi-spherical top portions and said corresponding semi-spherical bottom portions are connected together to form said lattice, wherein the axially projecting internal projections of said semi-spherical top portions and said corresponding semi-spherical bottom portions form internal support posts inside respective hollow bodies when said semi-spherical top portions and said corresponding semi-spherical bottom portions are connected together.

17. The apparatus of claim 1 wherein the at least one connector is integrally formed with the hollow bodies.

18. The apparatus of claim 1 wherein the at least one connector has a U-shape.

19. A concrete slab comprising:

the apparatus of claim 1;

said at least one reinforcement member on said at least one integrally formed outwardly extending support projection of said apparatus; and concrete encasing said apparatus and said at least one reinforcement member, wherein the hollow bodies define voids in the concrete and spaces between the hollow bodies contain at least some of the concrete and wherein at least one of a space between the lattice and a top surface of the concrete, a space between the lattice and a bottom surface of the concrete, and at least one of said spaces between the hollow bodies contains said at least one reinforcement member.

20. The concrete slab of claim 19, wherein the at least one reinforcement member comprises a reinforcing bar.

21. The concrete slab of claim 19, wherein the concrete slab is a wall or floor slab.

22. A method of making a concrete slab, the method comprising:

placing the apparatus of claim 1 within the bounds of a concrete form;

positioning at least one reinforcement member on a least one of said at least one integrally formed outwardly extending support projection such that the at least one reinforcement member is at least one of between adjacent ones of said hollow bodies or above said hollow bodies; and placing concrete into the concrete form to encompass the hollow bodies and said at least one reinforcement member; and curing the concrete to bind the apparatus, said at least one reinforcement member, and said concrete into a unitary solid mass.

23. A concrete slab made according to the method of claim 22.

* * * * *